US007407063B2

(12) United States Patent
Rockwell, III

(10) Patent No.: US 7,407,063 B2
(45) Date of Patent: Aug. 5, 2008

(54) CONTAINER

(76) Inventor: Dwight Rockwell, III, P.O. Box 1441, Bandon, OR (US) 97411

( * ) Notice: Subject to any disclaimer, the term of this patent is extended or adjusted under 35 U.S.C. 154(b) by 57 days.

(21) Appl. No.: 10/905,074

(22) Filed: Dec. 14, 2004

(65) Prior Publication Data

US 2005/0139602 A1 Jun. 30, 2005

Related U.S. Application Data

(60) Provisional application No. 60/529,542, filed on Dec. 15, 2003.

(51) Int. Cl.
*B65D 6/28* (2006.01)
*B65D 8/04* (2006.01)
*B65D 8/06* (2006.01)

(52) U.S. Cl. ..... 220/606; 220/608

(58) Field of Classification Search ..... 220/606, 220/631, 751, 570, 571.1, 669, 672, 608, 220/752
See application file for complete search history.

(56) References Cited

U.S. PATENT DOCUMENTS

| | | | | | |
|---|---|---|---|---|---|
| 568,579 | A | * | 9/1896 | Merrill | 220/751 |
| 2,672,742 | A | | 3/1954 | Amberg | |
| 3,207,461 | A | | 9/1965 | Holzwarth et al. | |
| 3,493,988 | A | * | 2/1970 | Tidwell | 15/257.06 |
| 4,122,973 | A | | 10/1978 | Ahern | |
| 4,151,927 | A | * | 5/1979 | Cvacho et al. | 220/606 |
| 4,201,306 | A | * | 5/1980 | Dubois et al. | 220/4.05 |
| 4,422,559 | A | * | 12/1983 | Landis | 220/270 |
| 5,016,774 | A | * | 5/1991 | Rodriguez | 220/254.1 |
| 5,054,661 | A | | 10/1991 | Hollje | |
| 5,071,028 | A | * | 12/1991 | Murphy | 220/601 |
| 5,143,242 | A | | 9/1992 | Millasich | |
| 5,341,969 | A | * | 8/1994 | Accardo et al. | 222/465.1 |
| 5,533,802 | A | * | 7/1996 | Garganese | 366/256 |
| 5,727,708 | A | * | 3/1998 | Erickson | 220/23.87 |
| 6,019,241 | A | * | 2/2000 | Burns | 220/570 |
| 6,199,718 | B1 | | 3/2001 | Ellis | |
| D460,845 | S | | 7/2002 | Bergman | |
| 6,619,498 | B2 | | 9/2003 | von Holdt, Jr. | |
| 6,708,838 | B2 | | 3/2004 | Bergman et al. | |
| D493,035 | S | | 7/2004 | Bergman | |
| 6,991,829 | B2 | | 1/2006 | Bergman | |
| 2001/0004985 | A1 | * | 6/2001 | Pertschi | 220/570 |
| 2004/0118881 | A1 | | 6/2004 | Bergman et al. | |
| 2005/0056648 | A1 | * | 3/2005 | Wien et al. | 220/495.07 |
| 2005/0161462 | A1 | | 7/2005 | Bergman | |

* cited by examiner

*Primary Examiner*—Anthony D Stashick
*Assistant Examiner*—Harry A Grosso
(74) *Attorney, Agent, or Firm*—Joseph P. Curtin, L.L.C.

(57) ABSTRACT

A container that can hold a liquid, such as paint, or a granulated material includes a side wall portion, a bottom portion formed at one end of the side wall portion, and a well region formed in the bottom portion. The bottom portion includes an inclined surface. Alternatively, the bottom portion can be shaped to be frustoconical, hemispherical or an inverted pyramid.

12 Claims, 7 Drawing Sheets

VIEW A-A'

VIEW A-A'

CONTAINER

CROSS-REFERENCE TO RELATED PATENT APPLICATION

The present patent application claims priority to provisional patent application Ser. No. 60/529,542 filed Dec. 15, 2003, invented by Dwight Rockwell, III, entitled "Container", and incorporated by reference herein.

BACKGROUND OF THE INVENTION

1. Field of the Invention

The present invention relates to a container. More particularly, the present invention relates to a container that can hold a liquid or a granular material.

2. Description of the Related Art

Containers, such as paint buckets, are generally formed to have a flat bottom surface. When the level of material is low, such a container must be tipped in order for the material contained therein to be more easily accessible. Accordingly, such a container is not stable while it is tipped.

Consequently, what is needed is a container that is not required to be tipped for easily accessing material contained therein.

BRIEF SUMMARY OF THE INVENTION

The present invention provides a container that is not required to be tipped for easily accessing material contained therein.

The advantages of the present invention are provided by a container that can hold a liquid, such as paint, or a granulated material includes a side wall portion, a bottom portion formed at one end of the side wall portion, and a well region formed in the bottom portion. According to the invention, the bottom portion includes an inclined surface. Alternatively, the bottom portion can be shaped to be frustoconical, hemispherical or inverted pyramidal. The container can also include a plurality of hook members formed at an end of the side wall portion that is distal from the bottom portion.

BRIEF DESCRIPTION OF THE DRAWINGS

The present invention is illustrated by way of example and not by limitation in the accompanying figures in which like reference numerals indicate similar elements and in which.

DETAILED DESCRIPTION OF THE INVENTION

Figure 1:
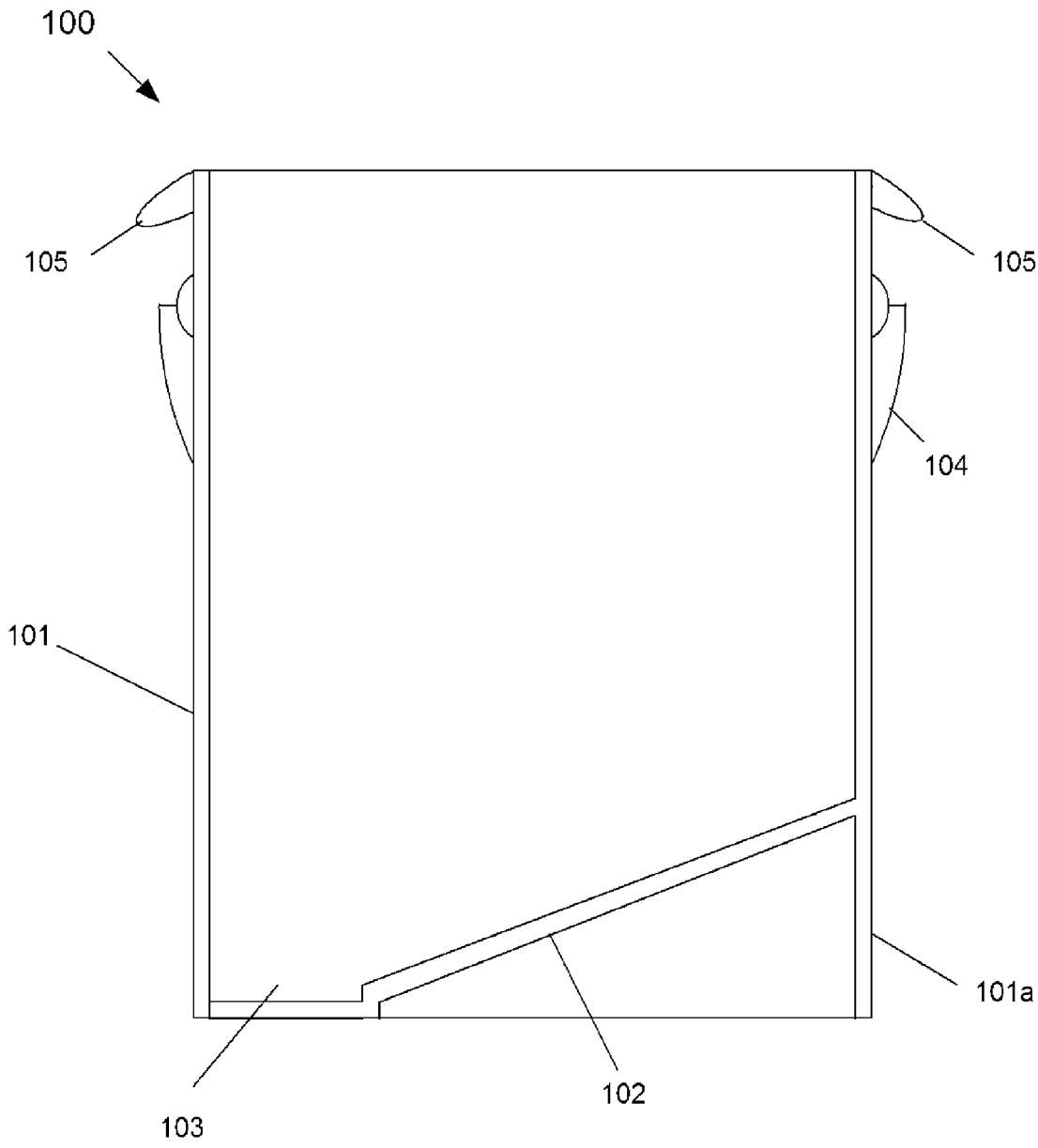
FIG. 1 is a cross-sectional view of an exemplary container according to the present invention.
Figure 2:
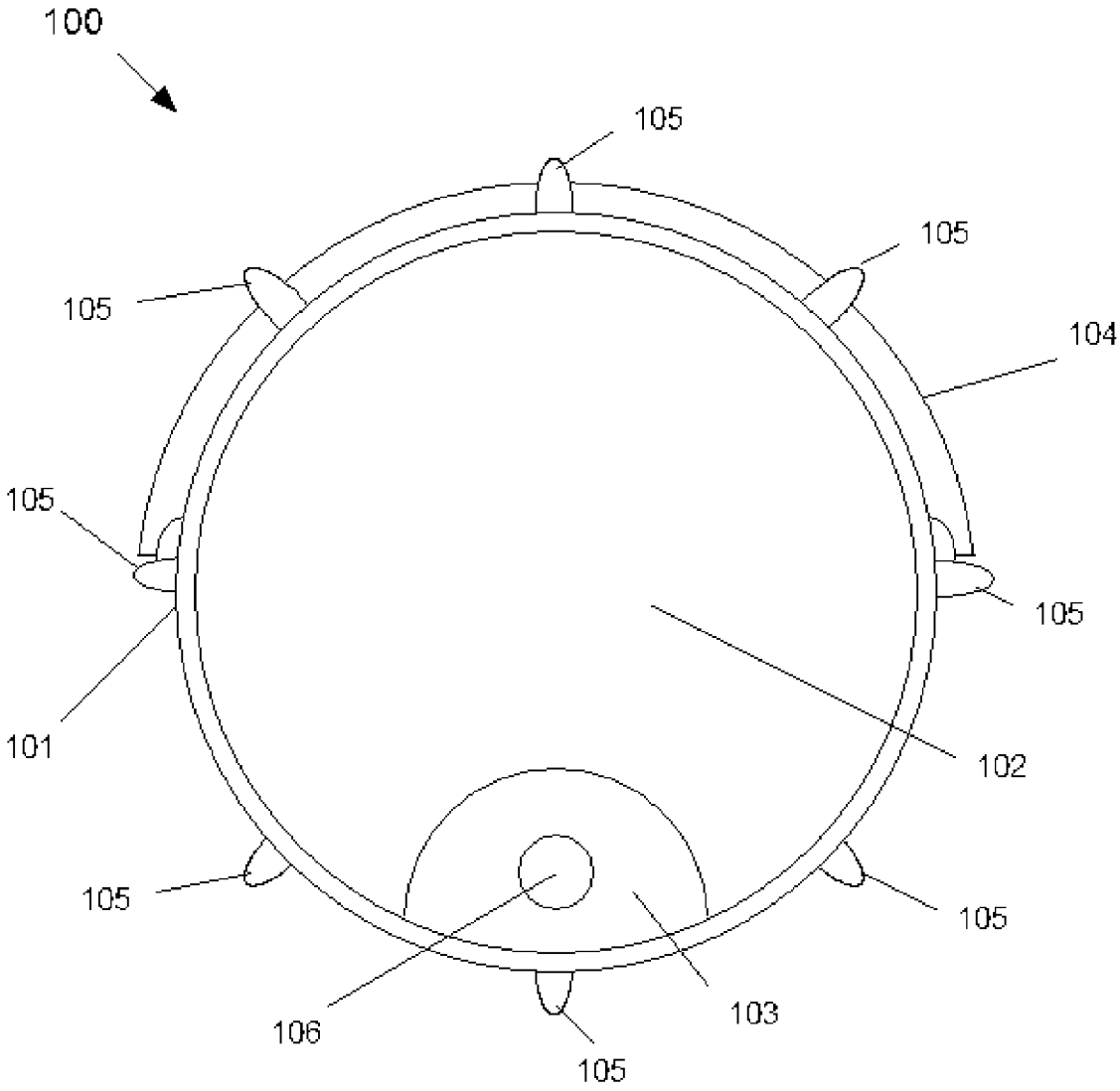
FIG. 2 is a top view of the exemplary container shown in FIG. 1.
Figure 3:
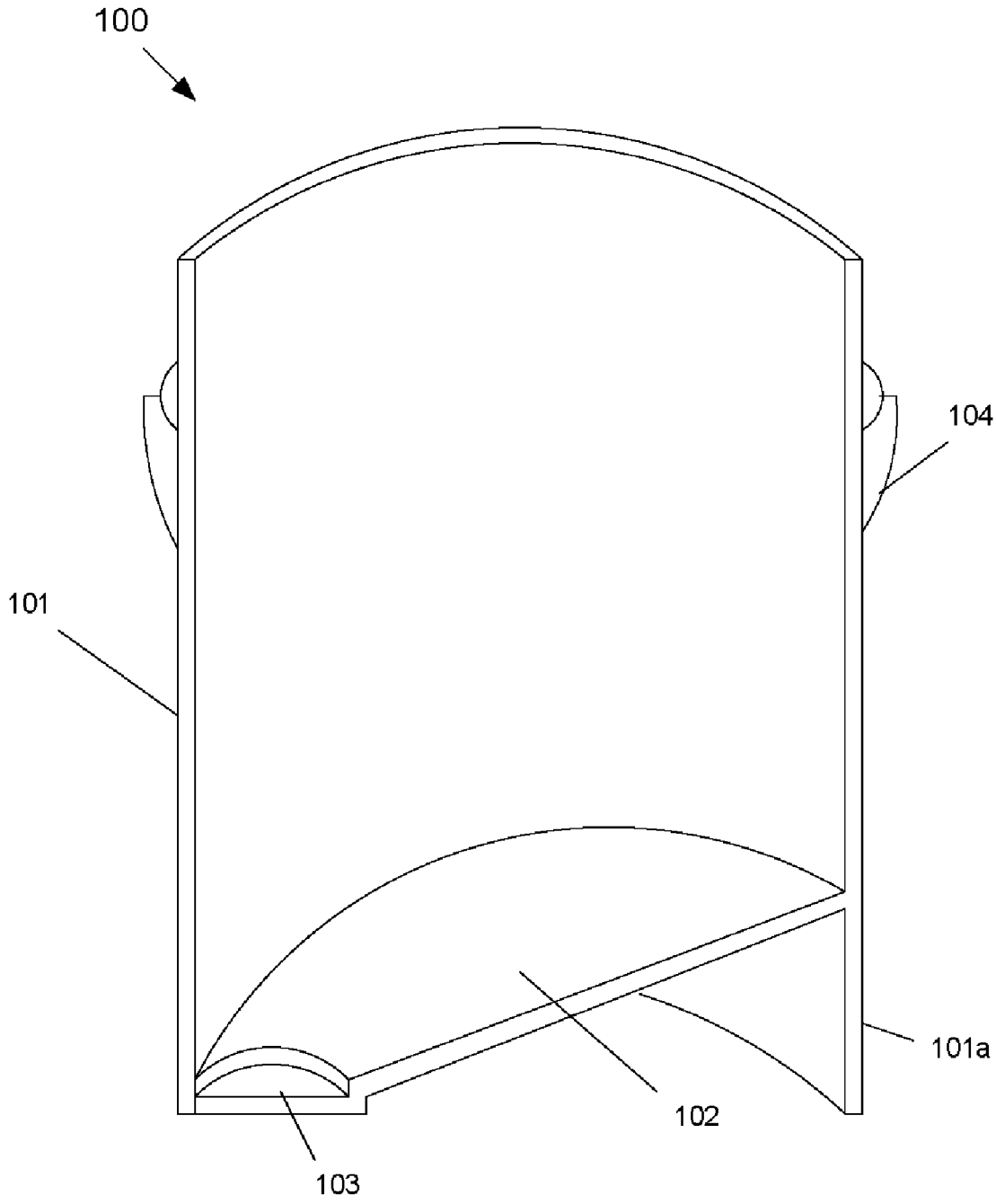
FIG. 3 is a cross-sectional perspective view of the exemplary container shown in FIG. 1.
Figure 7:
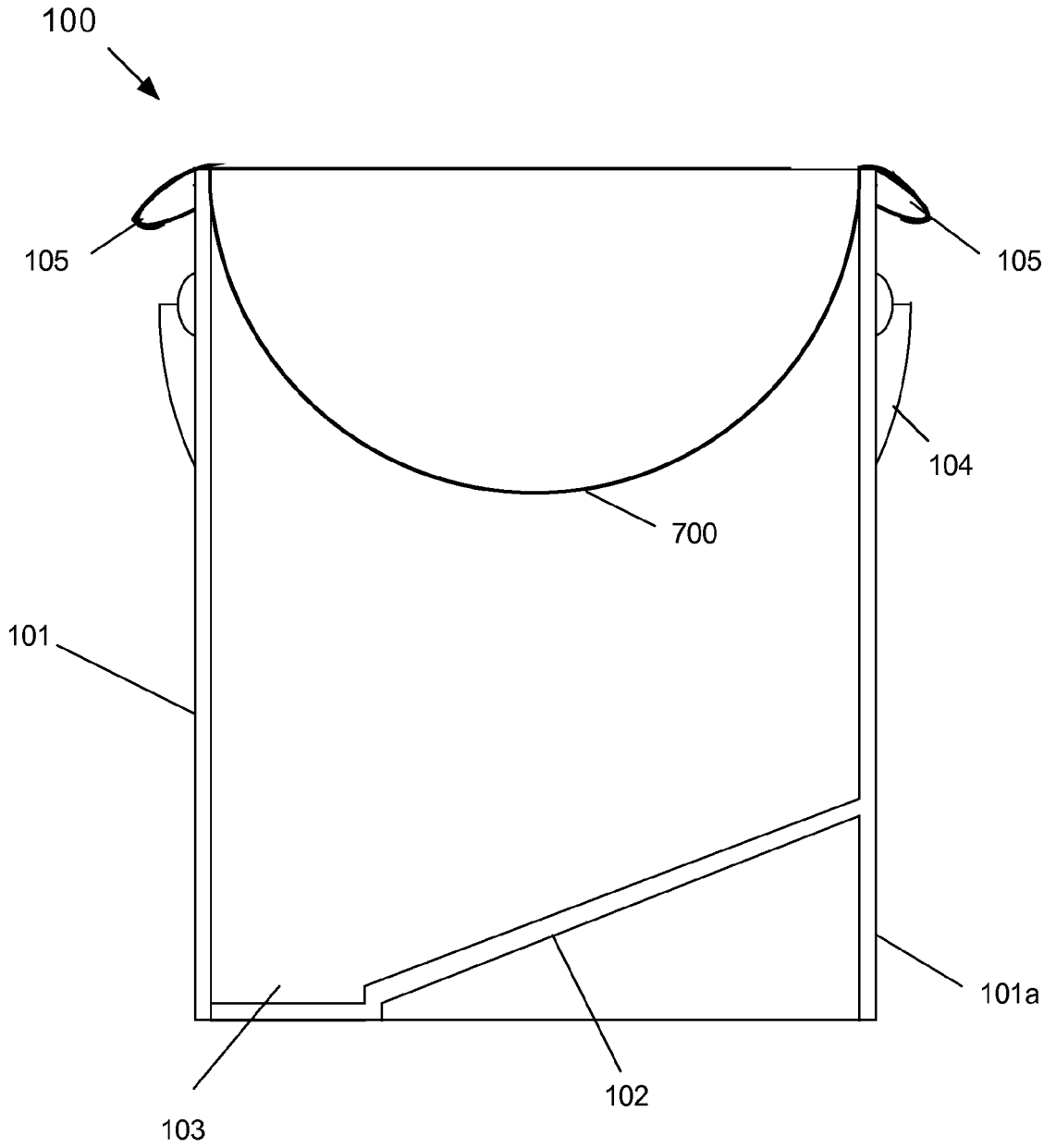
FIG. 7 shows a cross-sectional view of an exemplary container and a paint strainer according to the present invention.

FIG. 1 is a cross-sectional view of an exemplary container 100 according to the present invention. FIG. 2 is a top view of exemplary container 100. FIG. 3 is a cross-sectional perspective view of exemplary container 100. As shown in FIGS. 1-3, container 100 includes a side wall 101, a sloped bottom surface 102, and a well region 103. The arrangement of side wall 101, sloped bottom surface 102 and well region 103 forms a generally cylindrically shaped container that can hold a liquid or a granular material. Side wall 101 includes a portion 101*a* that extends below sloped bottom surface 102 so that container 100 is stable when placed on a horizontal surface, such as a floor or a table. Container 100 can also include a handle 104 and hook members 105 (not shown in FIG. 3). Hook members 105 are used for holding a liner that fits inside container 100. When container 100 contains paint, hook members 105 can be used for hooking a flexible paint strainer (700 in FIG. 7) so that paint can be strained when poured into container 100.

Container 100 is suitable for holding liquids and granular materials. As the level of contents of container 100 gets lower, the contents accumulate in well region 103 without container 100 being required to be tipped. The angle of sloped bottom surface 102 forms with a horizontal line (not shown) can vary depending on the viscosity of the liquid or the granularity of the material that will be contained in container 100. When the contents is a liquid, such as paint, the intake portion of a suction tube (not shown), such as for a paint sprayer, can be disposed in well region 103 to draw the paint into the paint sprayer. When the content of container 100 is a granular material, the granular material can exit through an opening 106 that is located in well region 103. Opening 106 can be a part of well region 103 that can be prescored and removed if desired. Alternatively, opening 106 can be formed in well region 103 and include a stopper or cover (not shown) so that material can be held within container 100.

While the shape of container 100 is shown to be generally cylindrical, it should be understood that a container according to the present invention can be different from generally cylindrical, such as square, rectangular or oval. Though not so limited, container 100 could be as small as the size of a one-gallon paint bucket or as large as a 55-gallon drum. Moreover, while sloped bottom surface 102 is shown as being a generally planar surface, it should also be understood that bottom surface 103 can have other shapes, such as frustoconical, hemispheric or an inverted pyramid. Further still, while well region 103 is shown as being off-center from a longitudinal axis (not shown), it should be understood that well region 103 could be centrally located with respect to such a longitudinal axis. Additionally, while a hollow space is depicted below sloped bottom surface 102 in FIG. 3, the sloped bottom surface could be a wedged-shaped insert that fits into the bottom of a container thereby forming a sloped bottom surface.

Figure 4A:
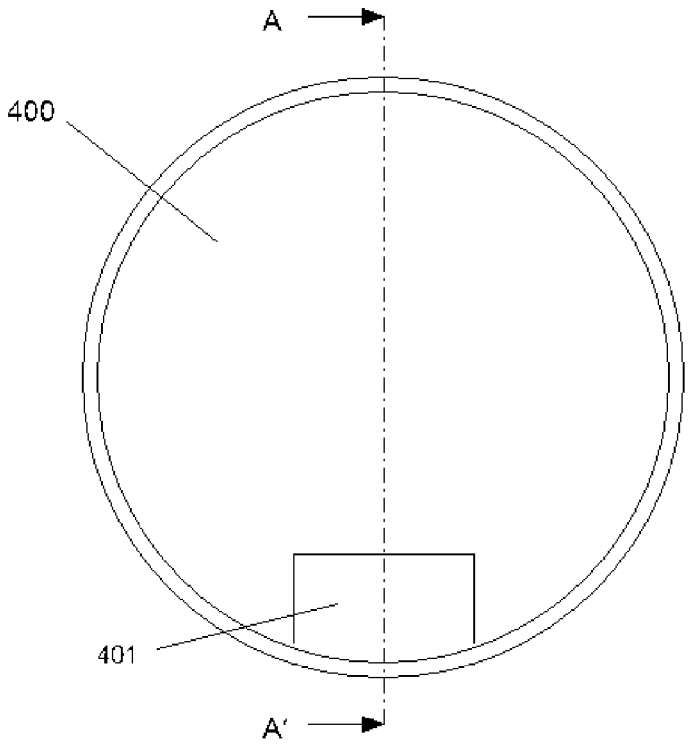
FIGS. 4A and 4B respectively show top and cross-sectional views of a first exemplary lid that can be used with a container according to the present invention.
Figure 4B:
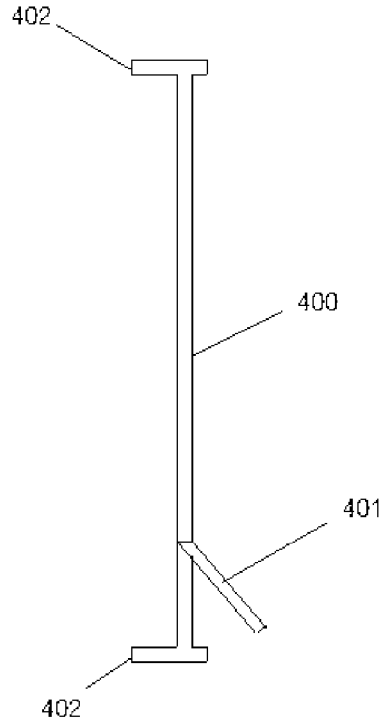
Figure 5:
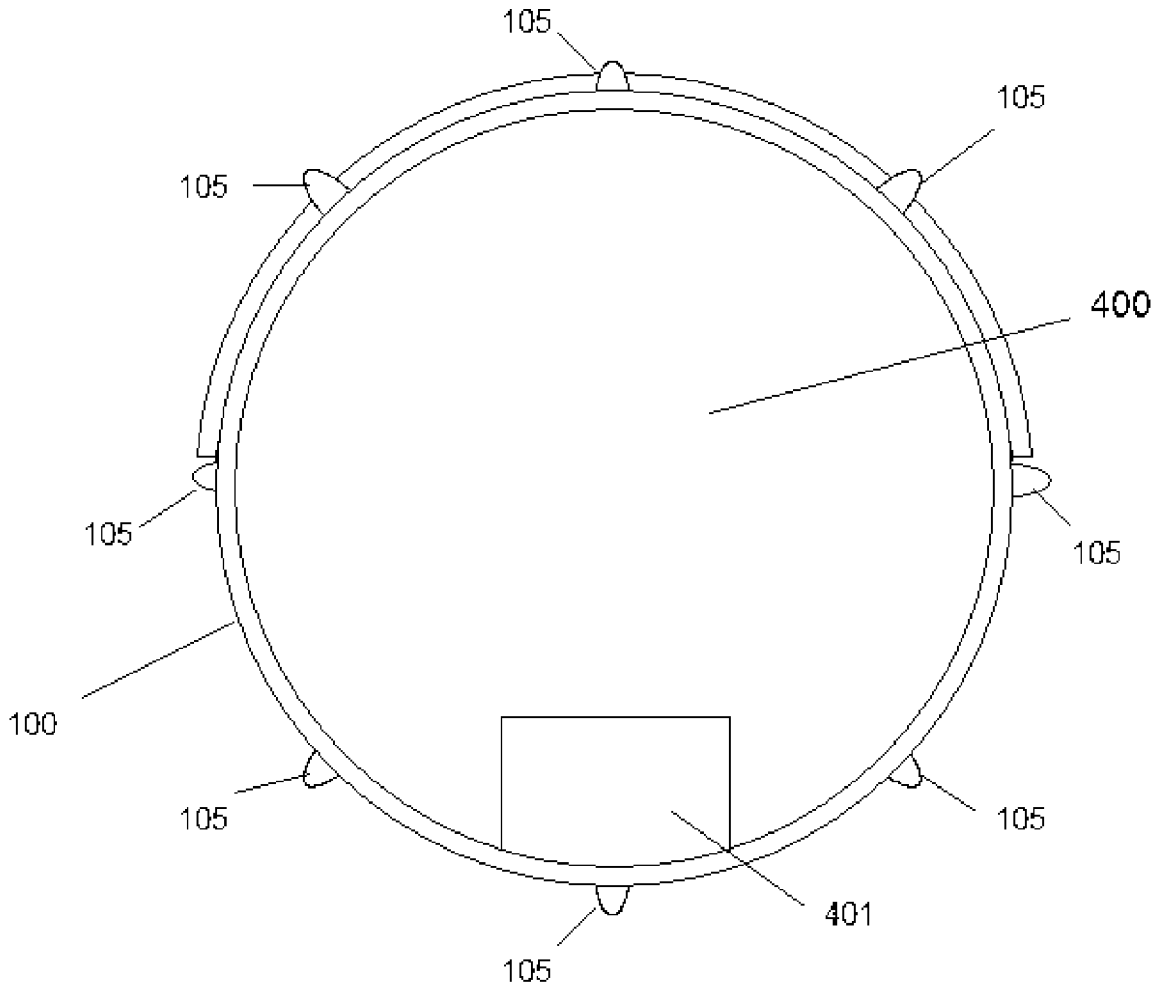
FIG. 5 shows a top view of the first exemplary container lid on a container according to the present invention.
Figure 6A:
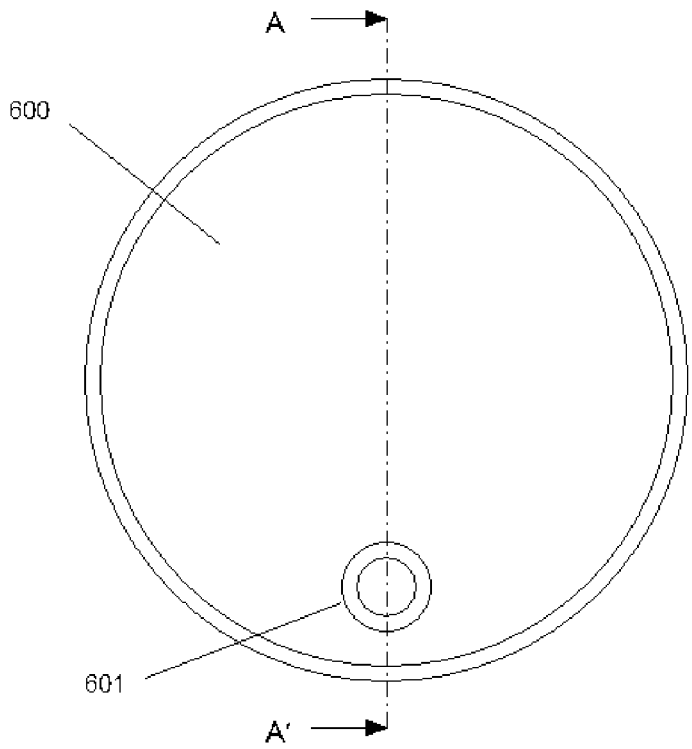
FIGS. 6A and 6B respectively show top and cross-sectional views of a second exemplary lid that can be used with a container according to the present invention.
Figure 6B:
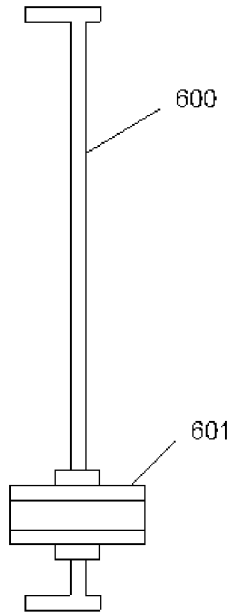

FIG. 4A shows a top view of a first exemplary lid 400 that can be used with a container according to the present invention. FIG. 4B shows a cross-sectional view of first exemplary lid 400 as viewed along line A-A'. FIG. 5 shows first exemplary lid 400 on container 100. Lid 400 includes a lift tab 401 that allows access to material in container 100, for example, for a siphon tube when the material in container 100 is a liquid, such as paint. Accordingly, lid 400 would be oriented on container 100 so that lift tab 401 would be positioned above well region 103. Lid 400 also includes flanges 402 to hold lid 400 in place on container 100. Flanges 402 can tightly fit against side wall 101 (FIGS. 1-3). Alternatively, there can be a small amount of space between flanges 402 and side wall 101 when lid 400 is placed on container 100 so that lid 400 essentially protects material in container 100 from becoming contaminated with unwanted materials. As yet another alternative, lid 400 does have a lift tab 401 and only has a hole at the place indicated by lift tab 401. As still another alternative, lid 400 does not have an opening. FIGS. 6A and 6B respectively show top and cross-sectional views of a second exemplary lid 600 that can be used with a container according to the present invention. Lid 600 includes an opening fixture 601 configured to accept a siphon hose (not shown) through opening fixture 601. Alternatively, a siphon tube can be press-fit into both sides of opening fixture. Lid 600 also includes flanges 602 to hold lid 600 in place on container 100 (not shown in FIG. 6). Flanges 602 can tightly fit against side wall 101 (FIGS. 1-3). Alternatively, there can be a small amount of space between flanges 602 and side wall 101 when lid 600 is placed on container 100 so that lid 600 essentially protects material in container 100 from becoming contaminated with unwanted materials. Opening fixture 601 would be positioned above well region 103 when lid 600 is on container 100.

Alternatively, the lid could have an opening that is sufficiently large to allow a screened intake for a siphon hose for a spray compression to be passed through the opening. The opening in the lid would then be positioned above well region 103 when the lid is placed on the container and the screened intake for the siphon hose would be lowered into well region 103.

Container 100 can be formed from materials such as plastic, metal, wood or ceramic, or a combination of any of these materials. Accordingly, exemplary lids 400 and 600 can also be made from materials such as plastic, metal, wood or ceramic, or a combination of any of these materials.

Although the foregoing invention has been described in some detail for purposes of clarity of understanding, it will be apparent that certain changes and modifications may be practiced that are within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A paint bucket, comprising:

a side wall portion of the paint bucket;

a bottom portion formed at one end of the side wall portion of the paint bucket; and a well region formed in the bottom portion of the paint bucket, an intersection of the bottom portion and a plane passing through the well region and traversing the side wall portion from a first location on the side wall portion that is proximate to the well region to a second location on the side wall portion that is substantially opposite the first location and distal to the well region comprising an inclined surface that comprises a constant increasing slope from the first location on the sidewall to the second location on the sidewall, and the paint bucket being hand-carryable.

2. The paint bucket according to claim 1, wherein the paint bucket is capable of holding a liquid.

3. The paint bucket according to claim 2, wherein the liquid comprises paint.

4. The paint bucket according to claim 1, further comprising a plurality of hook members formed at an end of the side wall portion that is distal from the bottom portion, each hook member being capable of receiving a paint strainer that is capable of straining paint passing through the paint strainer into the paint bucket as the paint strainer is received by the hook members.

5. The paint bucket according to claim 1, wherein the paint bucket is formed from a material comprising plastic.

6. The paint bucket according to claim 1, wherein at least a portion of the paint bucket is formed from a material comprising one of metal, wood and a ceramic material.

7. The paint bucket according to claim 1, further comprising a lid.

8. The paint bucket according to claim 7, wherein the lid comprises an opening that can be positioned above the well-region when the lid is on the paint bucket.

9. The paint bucket according to claim 7, wherein the lid further comprises a lift tab arrangement associated with the opening.

10. The paint bucket according to claim 7, wherein the lid comprises an opening that accommodates a siphon hose.

11. The paint bucket according to claim 7, wherein the lid comprises an opening that accommodates a fixture that accommodates a siphon hose.

12. The paint bucket according to claim 7, wherein the lid comprises an opening fixture adapted to receive a siphon hose.

* * * * *